US008709555B2

(12) United States Patent
Pal et al.

(10) Patent No.: US 8,709,555 B2
(45) Date of Patent: Apr. 29, 2014

(54) MEDIA USED IN DIGITAL HIGH SPEED INKJET WEB PRESS PRINTING

(75) Inventors: Lokendra Pal, San Diego, CA (US); Jason Swei, San Diego, CA (US); Glenn T. Gentile, San Diego, CA (US); Sandeep K. Bangaru, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/113,199

(22) PCT Filed: Apr. 28, 2011

(86) PCT No.: PCT/US2011/034403

§ 371 (c)(1),
(2), (4) Date: Oct. 21, 2013

(87) PCT Pub. No.: WO2012/148405

PCT Pub. Date: Nov. 1, 2012

(65) Prior Publication Data

US 2014/0044896 A1 Feb. 13, 2014

(51) Int. Cl.

| | |
|---|---|
| ***B41M 5/00*** | (2006.01) |
| ***B41M 5/50*** | (2006.01) |
| ***B41M 5/52*** | (2006.01) |
| ***D21H 11/04*** | (2006.01) |
| ***D21H 11/12*** | (2006.01) |
| ***D21H 13/06*** | (2006.01) |
| ***D21H 17/29*** | (2006.01) |
| ***D21H 21/20*** | (2006.01) |
| ***D21H 25/14*** | (2006.01) |

(52) U.S. Cl.

CPC ..... *B41M 5/502* (2013.01); *B41M 5/504* (2013.01); *B41M 5/508* (2013.01); *B41M 5/5218* (2013.01); *D21H 11/04* (2013.01); *D21H 11/12* (2013.01); *D21H 13/06* (2013.01); *D21H 17/29* (2013.01); *D21H 21/20* (2013.01); *D21H 25/14* (2013.01)

USPC ..... 428/32.21; 428/32.22; 162/135; 162/136; 162/141; 162/147; 162/149; 162/158; 162/175; 162/189; 162/231

(58) Field of Classification Search

CPC ..... B41M 5/502; B41M 5/504; B41M 5/508; B41M 5/5218; D21H 11/04; D21H 11/12; D21H 13/06; D21H 17/29; D21H 21/20; D21H 25/14

USPC ..... 428/32.21, 32.22; 162/135, 136, 141, 162/147, 149, 158, 175, 189, 231

See application file for complete search history.

(56) References Cited

U.S. PATENT DOCUMENTS 6,277,477 B1 * 8/2001 Tracy et al. ..... 428/32.23
6,287,743 B1 9/2001 Oakland et al.

(Continued)

OTHER PUBLICATIONS

Aidun, Cyrus K., Final Report Improving Paper Machine Efficiency Through On-Line Control of Stock Delivery, Headbox and Forming Hydrodynamics, Award No. De-FC36-99GO10416, Institute of Paper Science and Technology at Georgia Tech., Atlanta, GA, 2006, 35 pages. (from <http://www1.eere.energy.gov/industry/forest/pdfs/aidun.pdf >).

(Continued)

*Primary Examiner* — Betelhem Shewareged

(57) ABSTRACT

A media for digital high speed inkjet web press printing has a CD residual tensile energy absorption index greater than 300 J/Kg. The media includes a paper base having a MD/CD tensile stiffness index ratio of less than 2.0 and a tensile energy absorption index of greater than 500 J/Kg. The paper base includes a mixture of fibers having a softwood fiber to hardwood fiber ratio within a range of 3 to 7 to 7 to 1, an internal starch having a cationic starch to fiber ratio greater than 1.0%, and a filler within a range of about 1.0% to about 12.0% of paper base weight. The media further includes an image receiving coating on a side of the paper base.

15 Claims, 2 Drawing Sheets

(56) References Cited

U.S. PATENT DOCUMENTS

| | | | | |
|---|---|---|---|---|
| 6,805,929 | B2 * | 10/2004 | Koga et al. | 428/32.11 |
| 7,037,457 | B2 | 5/2006 | Seidel et al. | |
| 7,160,419 | B2 | 1/2007 | Suzuki et al. | |
| 2003/0087208 | A1 | 5/2003 | Bourdelais et al. | |
| 2004/0149412 | A1 | 8/2004 | Tammi et al. | |
| 2004/0200593 | A1 | 10/2004 | Koskinen et al. | |
| 2004/0258857 | A1 | 12/2004 | Dagan et al. | |
| 2008/0118676 | A1 | 5/2008 | Yamamoto et al. | |
| 2009/0035478 | A1 | 2/2009 | Zhou et al. | |
| 2009/0061332 | A1 | 3/2009 | Tamagawa et al. | |
| 2010/0043991 | A1 | 2/2010 | Huang et al. | |
| 2011/0171385 | A1 * | 7/2011 | Pal et al. | 427/256 |

OTHER PUBLICATIONS

Aidun, Cyrus K., Improving Paper Machine Efficiency Through On-Line Control of Stock Delivery, Headbox and Forming Hydrodynamics, Award No. De-FC36-99GO10416, Institute of Paper Science and Technology at Georgia Tech., Atlanta, GA, Apr. 6, 2006, 36 View graphs. (from < http://www1.eere.energy.gov/industry/forest/pdfs/aidun.pdf >).

Properties of Paper, 15 pages (from < http://www.paperonweb.com/paperpro.htm >), Nov. 23, 2010.

Better Quality and Runnability through Fiber Orientation Optimization, copyright 2010 METSO, 2 pages (from < http://www.metso.com/pulpandpaper/MPwArticles.nsf/WebWID/WTB-100121-2256F-B9DEB?OpenDocument >).

Gentile, Louis et al., Optimizing Press Section and Paper Machine Performance, Apr. 2006, 24 pages (from < http://www.tappi.org/Bookstore/Technical-Papers/Conference-Papers/2006/06PM/Optimizing-Press-Section-and-Paper-Machine-Performance-2006-Papermakers-Conference.aspx >).

International Search Report (ISR) and Written Opinion of/from the International Searching Authority (ISA/KR) for counterpart PCT patent application No. PCT/US2011/034403, dated Jan. 5, 2012 (8 pages).

* cited by examiner

MEDIA USED IN DIGITAL HIGH SPEED INKJET WEB PRESS PRINTING

CROSS-REFERENCE TO RELATED APPLICATIONS

N/A

STATEMENT REGARDING FEDERALLY SPONSORED RESEARCH OR DEVELOPMENT

N/A

BACKGROUND

There are a variety of methods for commercial high speed printing to produce large quantities of print material, such as books, magazines, newsprints, and brochures. In the past, traditional analog printers, such as web fed offset and gravure contact printers, were the most common type of printers for such commercial applications. In recent years, digital web fed high speed inkjet non-contact printers have become more prevalent due to 100% variable print content and multi-color printing at a relatively low cost to consumers.

Paper media for these more traditional types of web-fed offset or gravure printers have a high ratio of machine direction (MD) to cross-machine direction (CD) tensile stiffness that may be achieved during paper manufacturing. The high MD/CD tensile stiffness ratio means the print media can withstand the tension from being pulled tight around rollers that move the web in the machine direction at high speed in the press during printing. Paper media typically used for these more traditional analog printers can perform somewhat acceptably on high speed web fed inkjet (non-contact) printing devices.

BRIEF DESCRIPTION OF THE DRAWINGS

Various features of examples in accordance with the principles described herein may be more readily understood with reference to the following detailed description taken in conjunction with the accompanying drawings, where like reference numerals designate like structural elements, and in which.

Figure 1A:
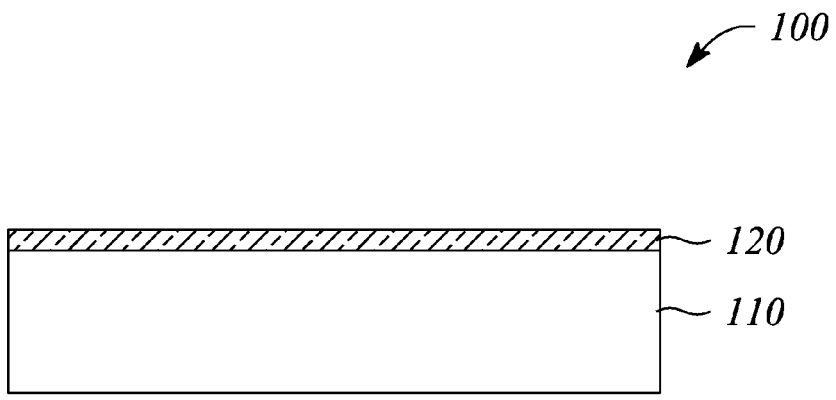
FIGS. 1A and 1B illustrate side views of media according to examples in accordance with the principles described herein.

Certain examples have other features that are one of in addition to and in lieu of the features illustrated in the above-referenced figures. These and other features are detailed below with reference to the preceding drawings.

DETAILED DESCRIPTION

While paper media typically used for more traditional analog printers can perform somewhat acceptably on high speed web fed inkjet (non-contact) printing devices, such paper media are subject to problems relating to one or more of cockle, curl, wrinkle, crease and mis-registration and other similar problems, which can detrimentally impact productivity, product quality and cost. For example, inkjet printing has a much higher moisture level than offset and gravure printing due to the colored pigments of the inkjet ink being applied to the paper media using a generally water based liquid vehicle.

Therefore, examples in accordance with the principles described herein are directed to a media that is more useful in digital high speed inkjet web press printing. The media according to the principles herein exhibits improved runnability during printing and finishing. The media is a light weight, coated, paper-based media in that the media comprises a paper base and a coating on one or both surfaces of the paper base that facilitates image formation on the media. The paper base has a machine direction/cross-machine direction (MD/CD) tensile stiffness index (TSI) ratio of less than 2.0 and a tensile energy absorption (TEA) index of greater than 500 J/Kg (TEA per basis weight) in each of the machine direction (MD) and the cross-machine direction (CD). Moreover, the media has a CD residual tensile energy absorption index greater than 300 J/Kg.

The low MD/CD TSI ratio means there are more random fiber orientations in the paper base at the expense of aligned fibers in the MD. More random fiber orientations mean more CD tensile stiffness that facilitates less CD (non-uniform) hygro-expansion of paper base fibers. Non-uniform hygro-expansion appears to be related to cockle and mis-registration issues, for example. Cockle refers to a small scale expansion in paper fiber width when wetted with water, for example from water-based inkjet inks. The low MD/CD TSI ratio was achieved mainly by reducing a difference between jetting speed and forming wire speed during paper manufacturing. The high TEA index (in both MD and CD) was achieved by increasing a ratio of cationic starch to fiber in the paper base. The high TEA index values mean a stronger media that has improved runnability during printing and during finishing with reduced (and in some examples, minimized) web breaks, cockling, wrinkling and creasing, for example. The media according to the principles described herein may provide one or more of excellent print quality, improved runnability during printing and finishing (one or both of inline and offline), and improved sheet cut quality for digital high speed inkjet web press production.

The paper base of the media according to the principles described herein comprises a mixture of softwood fibers and hardwood fibers. A ratio of softwood to hardwood fibers in the mixture is within a range of about 3 to about 7 to about 7 to about 1 (i.e., 3:7 to 7:1). In some examples, the softwood to hardwood ratio is a minimum of 3:7 and a maximum of 7:1. Moreover, the paper base comprises internal starch and inorganic filler. The internal starch includes, but is not limited to, a cationic starch provided in a ratio of cationic starch to fiber that is greater than 1.0%. The filler is provided in an amount sufficient to achieve ash content in a range of about 1.0% to about 12.0% of paper base weight.

In some examples, the paper base further comprises one or more agents and additives in a combined amount within a range of about 0.0075% to about 9.00% of fiber weight. For example, the paper base may further comprise internal sizing, one or more of a biocide, a preservative, a bleaching agent, one or both of a retention aid and a drainage aid, an optical brightening agent (OBA) and other functional additives and operational additives including, but not limited to dyes, defoaming agents, buffering agents, and pitch control agents, for example.

Further, the paper base may be surface treated or coated to improve holdout and fixing of an inkjet ink image on the surface of the media. The surface treatment solution or coating on the paper base is an image receiving layer that may be applied on one side or on both opposite sides of the paper base. The image receiving layer is compatible with water-based or solvent-based inkjet inks and therefore, also may be referred to herein as an ink receiving layer composition, surface treatment solution or coating. Such ink receiving compositions may include ink fixing agents, including but not limited to, a divalent metallic salt, a multivalent metallic salt (e.g., of calcium, magnesium or aluminum) and a combination of any these salts; and surface sizing additives (e.g., starch, fillers, and polymeric sizing agents). In addition, the ink receiving compositions may include one or more of pigments (e.g., clay and silica); binders (e.g., latex and polyvinyl alcohol); and other additives, for example, in a variety of combinations. Moreover, the inkjet inks that form images on the media may be dye-based or pigment-based carried and delivered to the paper media using water-based chemical solutions.

In some examples, the media (i.e., coated with the image receiving layer) used in digital high speed inkjet web press printing, as described herein, has a MD/CD TSI ratio of equal to or less than 1.9. The media further has a CD tensile energy absorption index of greater than 800 J/Kg.

As used herein, the article 'a' is intended to have its ordinary meaning in the patent arts, namely 'one or more'. For example, 'a filler' generally means one or more fillers and as such, 'the filler' means 'the filler(s)' herein. The phrase 'at least' as used herein means that the number may be equal to or greater than the number recited. The term 'about' as used herein means that the number recited may differ by plus or minus 10%, for example, 'about 5' means a range of 4.5 to 5.5. The term 'between' when used in conjunction with two numbers such as, for example, 'between about 2 and about 50' includes both of the numbers recited. Any ranges of values provided herein include values and ranges within or between the provided ranges. The term 'substantially' as used herein means a majority, or almost all, or all, or an amount with a range of about 51% to 100%, for example. Also, any reference herein to 'top', 'bottom', 'upper', 'lower', 'up', 'down', 'back', 'front', 'left' or 'right' is not intended to be a limitation herein. The designations 'first' and 'second' are used herein for the purpose of distinguishing between items, such as 'first side' and 'second side', and are not intended to imply any sequence, order or importance to one item over another item or any order of operation, unless otherwise indicated. Moreover, examples herein are intended to be illustrative only and are presented for discussion purposes and not by way of limitation.

In accordance with the principles described herein, the media used in digital high speed inkjet web press printing is a light weight, coated, porous media that has a low MD/CD TSI ratio of less than 2.0 to reduce CD hygro-expansion and cockle. The media further has a high TEA index of greater than 600 J/Kg to improve web press runnabililty and finisher runnability, including one or more of inline, near-line and offline finishing. As such, in digital high speed inkjet web press printing and finishing, the media exhibits acceptable sheet cut quality, for example clean edges with reduced fraying, fiber feathering or other general unevenness, and with reduced tendency to crease, cockle, wrinkle, or suffer web breaks. The low MD/CD TSI ratio of the media is achieved in part by increasing random fiber orientations in the paper base at the expense of fibers oriented in the machine direction (MD) when a paper web is formed. Increasing the random fiber orientations is described further below with respect to a method of making such media. In addition, a concomitant loss in MD TSI (due to less fiber orientation in MD) is compensated by increasing a level of cationic starch in the fiber furnish. In particular, increasing a cationic starch to fiber ratio of the paper base provides or facilitates the high TEA index characteristics of the media according to the principles described herein.

Moreover, the low MD/CD TSI ratio of less than 2.0 and high TEA index of greater than 600 J/Kg for the media are achieved in part by using a paper base that comprises a fiber mixture of softwood fibers and hardwood fibers in a softwood to hardwood fiber ratio that is within a range of about 3 to about 7 to about 7 to about 1, for example. In some examples, the softwood to hardwood fiber ratio is within a range of 3 to 6 to 6 to 1, or 3 to 5 to 5 to 1, or 3 to 4 to 4 to 1, 3 to 3 to 3 to 1, or any range in between these ranges, for example about 3 to about 7 to about 3 to about 1. In some examples, the softwood to hardwood fiber ratio is within a range of 3 to 3.5 to 3 to 4, or may be 1 to about 2. In another example, the softwood to hardwood fiber ratio is within a range of about 3 to about 1 to about 2 to about 1, or about 3 to about 7 to about 1 to about 1. Fibers from hardwood pulps have a shorter fiber structure and reduced strength with refining than softwood fibers. Therefore, a higher amount of softwood fiber is added to the fiber mixture or pulp to facilitate improved tensile stiffness and TEA. In some examples, the fiber mixture comprises a minimum of 30% softwood fibers. As such, the paper base of the media herein has a TEA Index that is not less than 500 J/Kg, or not less than 600 J/Kg, or not less than 700 J/Kg, for example.

Examples of softwoods useful for the fiber mixture include, but are not limited to, northern softwoods and southern softwoods, such as White Spruce and Pine from North America. Examples of hardwoods useful for the fiber mixture include, but are not limited to, southern hardwoods and northern hardwoods, such as Birch, Maple, and Aspen from North America. The fiber mixture of the paper base may further include non-wood fibers (e.g., one or more of bamboo, bagasse and straw), and recycled fiber (e.g., pre- and post-consumer fiber). The fibers may be included in the form of chemical pulp, mechanical pulp, or a hybrid pulp including, but not limited to, thermal mechanical pulp, chemical mechanical pulp, and Chemi-Thermo-Mechanical (CTMP) pulp, or a combination of any of these, for example. Examples of chemical pulps used in the fiber mixture include, but are not limited to, one or more kraft pulps and sulfite pulps, each of which may or may not be bleached. Bleached pulp is used to avoid possible brownish tint typically found in unbleached pulp.

In some examples, recycled pulp, mechanical pulp, hybrid pulp and non-wood fiber pulp each independently may be included in the fiber mixture in an amount (of total fiber weight) within a range of 0% to about 30%, or about 5% to about 30%, or about 10% to about 25%, or about 15% to about 20%, for example. In some examples, up to about 15% of the fiber mixture is recycled pulp. In some examples, up tot about 10% of the fiber mixture is mechanical pulp or a hybrid pulp. In some examples, the fiber mixture may include a range of about 25% to about 35% softwood chemical pulp, a range of about 20% to about 30% hardwood chemical pulp, and a combined amount in a range of about 40% to about 50% mechanical pulp, hybrid pulp and recycled pulp, such that a total amount of softwood in the fiber mixture is at least 30%. For example, the fiber mixture may include about 30% of softwood chemical pulp, about 25% hardwood chemical pulp, about 18% hybrid pulp and about 25% recycled pulp, such that a total amount of softwood in the fiber mixture is greater than 30%.

The paper base further comprises internal starch and inorganic filler. These internal agents are added to the fiber mixture or pulp stock before it is converted into a paper web (i.e., the paper base). The internal starch improves dry strength, and cationic starch may further act as a retention aid, for example. The internal starch includes a cationic starch and may further include one or more of anionic, cross-linked, liquid or dry pre gel, nonionic and amphoteric starch. The internal starch may be corn-based or potato-based, for example. The internal starch is provided in an amount that has a cationic starch to fiber ratio that is greater than 1.0%. In some examples, the ratio of cationic starch to fiber is equal to or greater than about 1.10%. In some examples, the cationic starch to fiber ratio is within a range of greater than 1.0% to about 5.0%, or in some examples, a minimum of 1.10% and a maximum of 5.0%. In some examples, the total internal starch (cationic and other types of starch) is provided in an amount within a range of greater than 1.0% to about 11.0% of the fiber weight. In some examples, the amount of the total internal starch is within a range of about 1.10% and about 11.0% of the fiber weight, or about 1.5% and about 11.0% of the fiber weight, or about 1.5% and about 10.0% of the fiber weight, or about 2.0% and about 11.0% of the fiber weight, or about 3.0% and about 11.0% of the fiber weight. Examples of starch include, but are not limited to, CHARGEMASTER® L335 Cationic Starch from GPC, Muscatine, Iowa, USA; Apollo® Cationic Corn Starch, Astro X® Cationic Potato Starch, Pencat® Cationic Corn Starch, and Topcat® Cationic Additive from Penford Products Company, Cedar Rapids, Iowa, USA; and STA-LOK® 120, 140, 160, 180 Cationic Waxy Starch, STA-LOK® 156, 182 Amphoteric Waxy Corn Starch, and STA-LOK® 300, 310, 330 Cationic Dent Corn Starch from TATE and LYLE, Decatur, Ill., USA (formerly A E Staley).

The inorganic filler substantially controls some physical properties of the paper base, for example. Particles of the filler fill in the void spaces of the fiber network and substantially result in one or more of a denser, smoother, and brighter paper base than without filler. However, less filler may be better for strength for example. Examples of fillers that may be incorporated into the fiber mixture of the paper base include, but are not limited to, ground calcium carbonate (GCC), precipitated calcium carbonate (PCC), titanium dioxide, clays and talc and combinations of any of the above. In some examples, the paper base comprises an amount by dry weight of filler (measured as ash content %) within a range of about 1.0% to about 12% of the paper base weight. In some examples, the amount of filler (ash content %) in the paper base ranges from about 1.0% to about 10.0%, or about 3.0% to about 10.0%, or about 5.0% to about 10.0%, or about 7.0% to about 10.0% by paper base weight. In some examples, the filler is provided in an amount sufficient to achieve less than about 12% ash content. Examples of filler include, but are not limited to, Magfil® PCC from Specialty Minerals, Inc. of Bethlehem, Pa., USA, or Omyafil® GCC from Omya North America.

In some examples, the paper base further comprises agents and additives that provide functional and operational benefits. These agents and additives also may be added to the fiber mixture or pulp stock before it is converted to the paper web. For example, an internal sizing may be provided in the fiber mixture of the paper base in an amount greater than 0.01% of the fiber weight to improve water resistance properties. For example, more internal sizing may lessen ink-water interaction with the fibers in the paper base. In some examples, internal sizing may be included in an amount within a range of about 0.015% and about 1.00% of the fiber weight. Examples of internal sizing agents include, but are not limited to, one or more of fatty acids, alkyl ketene dimer (AKD) emulsification products, alkenyl acid anhydride emulsification products, alkylsuccinic acid anhydride (ASA) emulsification products, and rosin derivatives. Some examples of commercially available ASA and AKD include, but are not limited to, Nalco 7542 ASA from Nalco Company, IL, USA and AKD 2030 from BASF, and Hercon 195 AKD from Hercules Inc. USA.

In some examples, the paper base may further comprise from about 0.01% to about 5.00% by fiber weight of one or more of a biocide, a bleaching agent and a preservative (herein collectively 'bleach/biocide'). Some examples of commercially available biocides include, but are not limited to, Busan®1124, 1130, 1210, 1223 from Buckman Laboratories, Memphis, Tenn., USA and Spectrum™ XD3899 micro-biocide from Ashland Inc., Covington, Ky., USA. In some examples, the amount of bleach/biocide is about 1% by fiber weight. In some examples, the paper base may further comprise about 0.05% to about 2.00% by fiber weight of one or both of a retention aid and a drainage aid (herein collectively 'retention/drainage' aid). Examples of retention/drainage aids include, but are not limited to, one or more of a polyacrylamide, polyaluminum chloride, silica-type microparticles, a flocculant and a dispersant. In some examples, about 0.10% to about 0.30% by fiber weight of a retention/drainage aid is included in the paper base. In some examples, the paper base may further comprise an optical brightening agent (OBA) to control color, for example, in an amount within a range of about 0.0075% to about 0.25% by fiber weight. In some examples, about 0.04% to about 0.06% by fiber weight of OBA is included in the paper base. Other agents and additives including, but not limited to, dyes, defoaming agents, buffering agents and pitch control agents may be included in the fiber mixture of the paper base in some examples. These other agents and additives may be included in a combined amount within a range of about 0.0075% to about 9.0% by fiber weight, or about 0.08% to about 8.5%, or about 0.10% to about 6.0%, or about 0.50% to about 5.0%. In some examples, the combined amount of these other agents and additives in the paper base is within a range of about 1.0% to about 2.0% by fiber weight.

In some examples, the paper base may receive one or more layers or coatings (e.g., a surface sizing) to the paper web surface in a paper machine during paper manufacture. These layers or coatings facilitate one or more of smoothness, whiteness, gloss, porosity, and opacity, for example, of the paper web. These coatings are intermediate coatings that are separate and distinguishable from the image receiving coating layer further described herein. As such, the paper base may be uncoated (e.g., no surface sizing), or coated with intermediate coatings (e.g., of surface sizing), as mentioned herein, depending on the example, before the image receiving surface treatment or coating layer is applied.

In some examples, the paper base of the media has a basis weight within a range of about 30 grams per square meter (gsm) to about 74 gsm. In some examples, the basis weight of the paper base is within a range of about 35 gsm to about 74 gsm, or about 40 gsm to about 74 gsm, or about 45 gsm to about 74 gsm, or about 50 gsm to about 74 gsm, or about 60 gsm to about 74 gsm. In some examples, the basis weight of the paper base of the media is about 50 gsm to about 60 gsm.

Figure 1B:
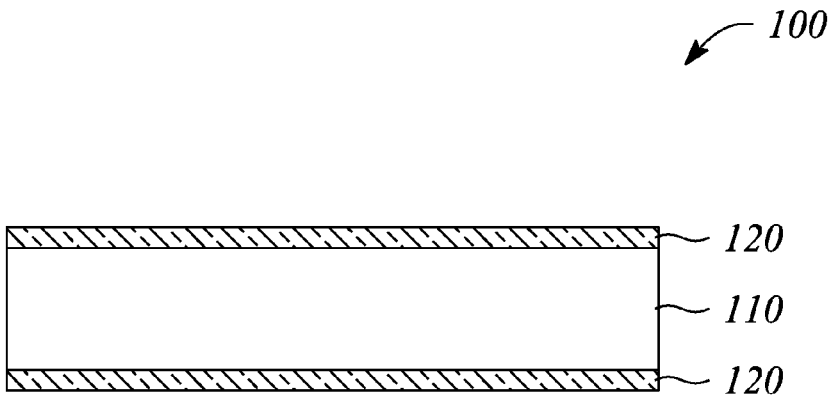

According to the principles described herein, the media includes an image receiving layer (i.e., surface treatment or coating) on one or both sides of the paper base of the media. FIG. 1A illustrates an example of the media 100) with an image receiving layer 120) on one side of the paper base 110); and FIG. 1B illustrates an example of the media 100) with an image receiving layer 120) on both sides of the paper base 110), each in accordance to the principles described herein. The image receiving layer 120) comprises an image receiving composition capable of receiving and retaining an inkjet ink imaging material applied in a pattern (or image) to the layer. The image receiving layer 120) is an outermost layer on the paper base 110). The inkjet ink may be water-based or solvent-based and includes either dyes or pigments for color, depending on the particular inkjet ink. In some examples, the image receiving layer 120) may facilitate relatively improved bleed and dry time of the inks that are applied thereto. There are a variety of image receiving compositions that may be used for the image receiving layer 120) on the paper base 110) of the media 100) according to the principles described herein.

In some examples, the image receiving composition comprises ink fixing agents including, but not limited to, divalent or multivalent metallic salts (e.g., a chloride, a bromide, a nitrate or an acetate of calcium, magnesium or aluminum or a combination of any of these); one or both of inorganic pigment fillers (e.g., clay, carbonates, silica gels, and fumed silica) and organic pigment fillers (e.g., polystyrene and polyacrylates); one or both of a water-based binder and a water dispersible binder (e.g., latex, polyvinyl alcohol (PVA), starch, styrene-butadiene or acrylates); and one or more of a variety of additives. For example, other additives including, but not limited to, one or more of surface sizing agents, wetting agents, de-foaming agents, anti-foaming agents and dispersing agents also may be incorporated into the image receiving layer.

In some examples, a basis weight of the image receiving coating on the paper base is within a range of about 1 gsm to about 15 gsm. The coating basis weight is a total of the coating basis weight on one or on both sides of the paper base. In some examples, the total coating basis weight on the paper base is within a range of about 2 gsm to about 15 gsm, or about 4 gsm to about 15 gsm, or about 6 gsm to about 15 gsm, or about 8 gsm to about 15 gsm, or about 10 gsm to about 15 gsm, or for example, a total coating basis weight of about 13 gsm.

As such, the media according to the principles described herein is light weight, for example having a basis weight within a range of about 31 gsm to about 75 gsm. In some examples, the basis weight of the media is within a range of about 35 gsm to about 75 gsm, or about 40 gsm to about 75 gsm, or about 45 gsm to about 75 gsm, or about 55 gsm to about 75 gsm, or about 60 gsm to about 70 gsm. In some examples, the basis weight of the media is less than 75 gsm, for example about 70 gsm, or about 65 gsm.

Figure 2:
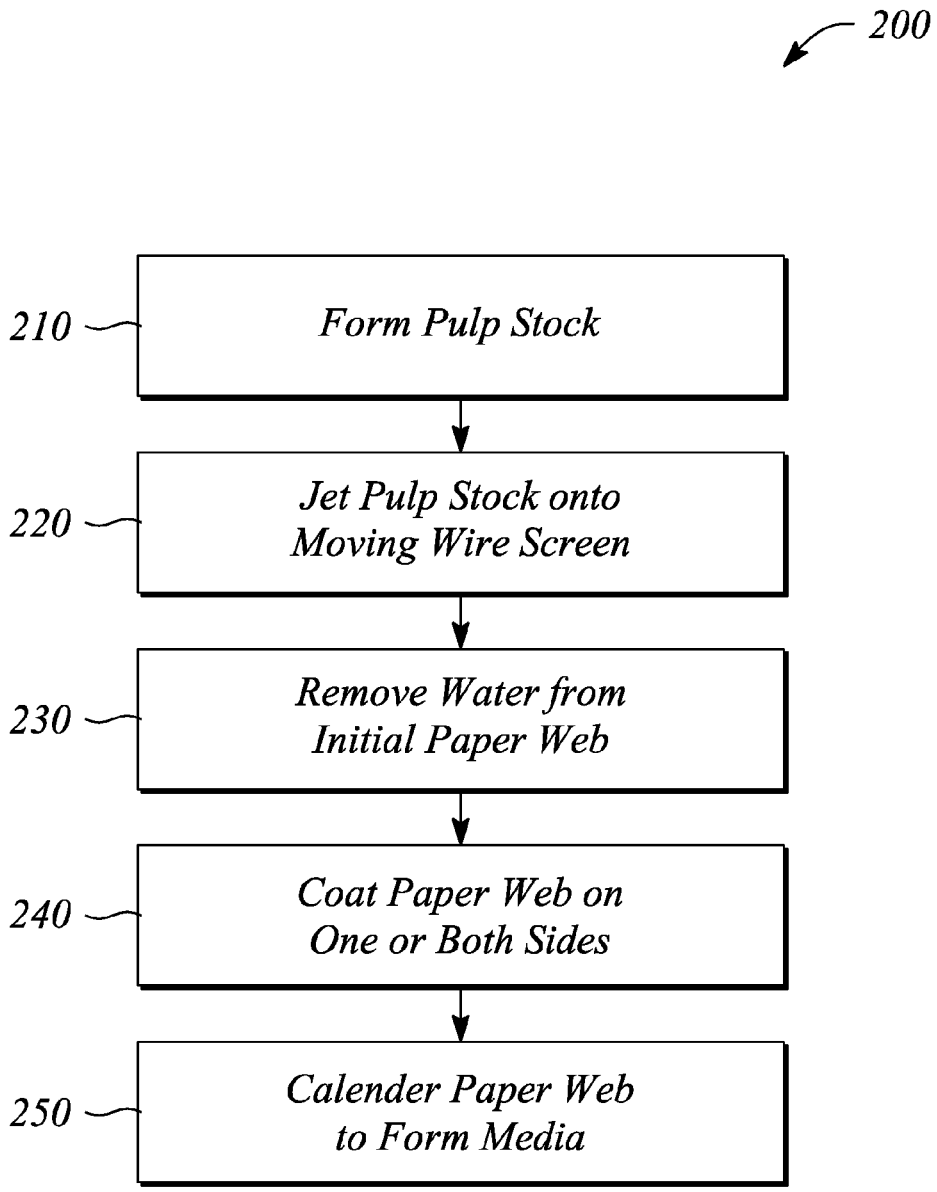
FIG. 2 illustrates a flow chart of a method of making media according to an example in accordance with the principles described herein.

A method of making media used in digital high speed inkjet web press printing is also provided. FIG. 2 illustrates a flow chart of a method 200) of making such media according to an example of the principles described herein. The method 200) of making comprises forming 210) a pulp stock that comprises a fiber mixture of refined cellulose fibers and non-fibrous functional and operational additives and agents. For example, the cellulose fiber mixture includes softwood fibers and hardwood fibers in a softwood:hardwood ratio that is within a range of about 3:7 to about 7:1. In some examples, non-wood fiber may be included also. The softwood, the hardwood and the non-wood fibers are provided as one or more of recycled pulp, chemical pulp, mechanical pulp, and hybrid pulp, for example. In some examples, the fiber mixture includes about 50% to about 60% chemical pulp. In some examples, about 15% to about 30% recycled pulp may be included in the fiber mixture. In other examples, about 10% to about 20% of one or both mechanical pulp and hybrid pulp may be included in the fiber mixture either in addition to or in lieu of the recycled pulp. In the above examples, at least 30% of the pulp in the fiber mixture is softwood. The fiber mixture is substantially the same as that described above for the paper base of the media according to the principles herein.

In some examples, wood chips may be pressure-cooked with a mixture of water and chemicals in a digester to form a pulp. In fiber mixtures that include non-wood fibers, non-wood chips are cooked in a separate digester with respective chemicals and then added to the wood pulp mixture. In other examples, commercially available virgin softwood and hardwood fibers may be used. The pulp is washed, cleaned and in some examples, bleached, then refined in a beater or refiner using one or both of chemical and mechanical refining. The non-fibrous functional and operational additives and agents are added and mixed with the pulp to form the pulp stock (i.e., fiber furnish). Such additives and agents include internal starch and inorganic filler, as well as other additives and agents, (e.g., internal sizing, OBA etc.) described above for the examples of the paper base of the media.

In some examples, the softwood to hardwood fiber ratio and the amounts of filler and internal starch are substantially equivalent to the amounts described above for the examples of the paper base of the media. In some examples, the amounts of other agents and additives are also substantially equivalent to the amounts described above for the examples of the paper base of the media.

The method 200) of making media further comprises jetting 220) the pulp stock onto a moving wire screen of a paper making machine at a jet-to-wire speed ratio of between about 0.95 and about 1.05 to form an initial paper web. The jet-to-wire speed ratio is dependent on the paper making machine used, and more particularly, the machine components or configuration used, e.g., headbox, slice, or forming board, etc. As the pulp travels down the wire screen, water, also referred to as 'white water' in the industry, is drained away and recirculated or reused in the system. As provided above, the low MD/CD TSI ratio of the media is achieved in part by increasing random fiber orientations in the paper base at the expense of fibers oriented in the machine direction (MD) during forming a paper web of the fiber mixture.

In some examples, the jet-to-wire speed ratio impacts fiber orientations and formation of the paper web or sheet. A velocity at which the jet of pulp stock is emitted from the headbox or slice of the paper making machine relative to the speed of the wire screen determines 'rush' or 'drag'. For example, a jet velocity that is slower than the wire speed produces 'drag' and a jet velocity that is faster than the wire speed produces 'rush'. When the differential between the jet velocity and the wire speed is large, then a substantial amount of the fibers of the paper web will be aligned in the machine direction (MD). However, when the differential between the jet velocity and the wire speed decreases, the fiber orientation in the MD will decrease and random fiber orientations will increase in the paper base. Depending on the paper making machine used, a jet-to-wire speed ratio of between about 0.95 and about 1.05 increases random fiber orientations (i.e., less fibers oriented or aligned in the machine direction in the paper web). For example, a jet-to-wire speed ratio of about 1 may provide a low MD/CD TSI ratio, depending on the machine configuration.

The degree of fiber orientation or alignment effects paper attributes since the fibers have different physical properties in an axial direction and a radial direction of the fibers. Less fiber orientation or alignment in the MD facilitates cross-machine direction (CD) strength to increase at the expense of the MD strength. Such higher CD strength provides for a lower MD/CD TSI ratio and a resultant paper sheet that has increased dimensional stability to reduce mis-registration during high speed printing using an inkjet web press, for example. Moreover, as the dimensional stability of the paper web increases, tendencies of the paper to curl, cockle, wrinkle and crease are reduced. Theoretically, at a jet-to-wire speed ratio of about 1.0, the MD tensile strength is at a minimum and the CD tensile strength is at a maximum (with minimum fiber orientation). As such, the MD/CD TSI ratio of the paper web may be considered to be at its lowest achievable value at the jet-to-wire speed ratio of about 1.0, for example, and the actual ratio depends on the paper making machine and its configuration.

The method 200) of making media further comprises removing 230) water from the initial paper web in a manner that prepares the paper web for surface sizing. For example, the initial paper web is squeezed between large rollers of the paper making machine to remove most of the remaining water and form a semi-dry web. Moreover, the large rollers ensure smoothness of the paper web and uniform thickness of the paper web. To further prepare the paper web for surface sizing or coating, the semi-dry web is run through heated dryer rollers that remove more remaining water. The percent solids (%) in the paper web goes from about 0.5% at the headbox to about 95% before surface sizing and applying the outermost coating layers, such as the image receiving layer coating.

The method 200) of making media further comprises coating 240) the paper web on one or both opposite sides. For example, coating 240) the paper web comprises applying an image receiving composition that is compatible for images printed with water-based or solvent-based inkjet inks In some examples, coating 240) the paper web may further include other intermediate coating layers (e.g., surface sizing, coatings) prior to applying the image receiving composition on the paper web.

The image receiving composition may be applied to the paper web using one or more techniques including, but not limited to, size press coating, metered size press coating, puddle size press coating, slot die coating, curtain coating, blade coating, Meyer rod coating, spray coating, dip coating, cascade coating, roll coating, gravure coating, air knife coating, cast coating, and calender stack. In some examples, the image receiving composition is applied using an inline size press or coating station with the paper making machine, during one or both of a surface sizing stage and coating stage of manufacture, for example. In some examples, the image receiving coating may replace an intermediate coating of surface sizing.

The method 200) of making media further comprises calendering 250) the coated paper web inline or offline to form the media. A calendering process may be performed after the image receiving layer is dried to improve surface smoothness and gloss, for example. The calendering process may include hardnip calender, super calender or hot soft nip calender. In some examples, smoothness and gloss target values may be achieved using an on-line hardnip or hot soft calender with the paper machine. The media is wound into large rolls that can be slit and rewound into roll sizes compatible for use in digital high speed inkjet web press printing, and may be wrapped for protection during shipping. The media made according to the method 200) described herein has an MD/CD TSI ratio of less than 2.0 and a CD residual TEA index that is greater than 300 J/Kg to facilitate digital high speed inkjet web press printing and finishing inline or offline. The media rolls may be used to produce print materials, e.g., books, magazines, newsprints, and brochures, with high print and finish quality and low production costs.

In some examples, the paper base of the media according to the principles described herein has a TEA Index greater than about 600 J/Kg, or equal to or greater than about 700 J/Kg. In some examples, the paper base has a CD TEA Index greater than about 500 J/Kg, or greater than about 800 J/Kg, or greater than about 1000 J/Kg, or equal to about 1200 J/Kg. In some examples, the paper base has a residual TEA Index greater than about 400 J/Kg, or greater than about 500 J/Kg, or equal to or greater than about 600 J/Kg. In some examples, the paper base has a CD residual TEA Index greater than about 700 J/Kg, or greater than about 850 J/Kg, or equal to about 1000 J/Kg. Moreover in these examples, the media according to the principles described herein has a CD TEA Index greater than 700 J/Kg, or greater than about 800 J/Kg, or greater than about 900 J/Kg, or equal to about 1000 J/Kg. In some examples, the media has a MD TEA Index greater than 600 J/Kg. In some examples, the media has a MD residual TEA Index greater than about 60 J/Kg, or greater than about 70 J/Kg. In some examples, the media has a CD residual TEA Index greater than 300 J/Kg and less than about 500 J/Kg.

In some examples, the paper base of the media according to the principles described herein has a TEA Index within a range of greater than 500 J/Kg to about 1200 J/Kg. In some examples, the paper base has a residual TEA Index within a range of about 400 J/Kg to about 1000 J/Kg. Moreover in these examples, the media according to the principles described herein has a CD TEA Index within a range of greater than 700 J/Kg to about 1000 J/Kg. In some examples, the media has a MD residual TEA Index within a range of greater than about 60 J/Kg to about 80 J/Kg. In some examples, the media has a CD residual TEA Index within a range of greater than about 300 J/Kg to about 485 J/Kg.

EXAMPLES

All measured values are within measurement tolerance for the equipment used, unless otherwise indicated.

Paper Base Media Samples: Paper media was fabricated using 100 parts of a fiber mixture that included about 31 parts softwood bleached kraft pulp, 25 parts hardwood bleached kraft pulp, 17 parts hardwood bleached chemi-thermomechanical (BCTMP) pulp and 27 parts recycled fibers and machine broke, together in water. Both softwood and hardwood kraft pulps were refined separately using a double disc refiner to achieve target tensile stiffness and target tensile energy absorption and mixed with other fibers in the ratio mentioned above. Internal cationic starch Sta-Lok® 300 was added at a dosage rate of 1.15% of the fiber weight to the fiber furnish to further increase the strength of the paper. Additionally Omya-fil® GCC inorganic filler was added into the fiber furnish to achieve about 11% target ash content (measured inline) to enhance opacity, brightness and whiteness. Internal sizing agent ASA was emulsified using cationic starch at 1 to 4 ratio and added at a total dosage rate of 0.64% of the fiber weight to the fiber furnish. Additionally, other additives such as OBA and dyes for color adjustments, retention/drainage aids and biocides for operational efficiency were added into the final stock.

The paper base media was made using a commercial Fourdrinier paper machine. A very low consistency (0.5%) pulp stock was jetted from the headbox at a jet-to-wire speed ratio of 1.01, and then the water was removed by filtration, pressing and drying to continuously form a web of paper base. The initial web was drained of water and passed through large rollers to remove more water and ensure smoothness and uniform thickness of the semi-dry paper web. The semi-dry paper web was run through steam heated dryers of the paper making machine to remove the remaining water and achieved the final moisture target of 4.7% in the paper web (i.e., paper base media). A 'Base Only' paper media sample was created from the paper web. Moreover, a 'Coated' paper media sample was created from the paper web, as described further below.

Image Receiving Layer Composition: An image receiving composition was prepared that included the following materials and amounts:

| Image Receiving Composition - Ingredients: | Parts |
|---|---|
| HYDRAGLOSS ® 91 (kaolin clay) | 38.3 |
| KAOCAL (calcined clay) | 25.6 |
| NUCLAY ® (pigment) | 35.9 |
| KURARAY PVA-403 | 7.03 |
| AC-22 Dispersant | 0.35 |
| STR-5401 Latex | 1.93 |
| Calcium Chloride | 12.75 |
| Boric Acid Solution | 0.58 |
| LEUCOPHOR T-100 (OBA) | 0.15 |
| CARTAREN VIOLET (organic pigment) | 0.00245 |
| STEROCOLL 802 (rheology modifier) | 0.5 |

The image receiving composition had the following properties:

| Image Receiving Composition Fluid Properties: | |
|---|---|
| Solid Content, % | 41.7 |
| pH | 4.82 |
| Temperature (Deg C.) | 30.5 |
| Brookfield Viscosity (cP), Spindle#4 & 100 rpm | 1110 |

An offline metering size press was used to apply the image receiving composition to the paper media. Both sides of the paper media were coated with the image receiving composition simultaneously. The coating was applied at 700 meters/minute and metered off using a smooth rod with a target coat weight of 7 gsm/side. The coating was dried using electric IR-dryers, gas IR-dryers and hot-air dryers. The final moisture target was 5.0%. An on-line, two nips soft-nip calender was used to calender the coated paper. The temperature of the surface of the hard rolls was adjusted to 60° C. and the load of the nips was adjusted to 300 kilo Newtons per meter (kN/m) in order to achieve a target caliper of the final coated media.

Control Samples: A 'base only' control sample and a 'coated' control sample of a printing paper typically used in offset printing that has a high MD/CD TSI ratio greater than 2.0 were used in this Example. The coating used on the 'coated' control sample was the same image receiving composition described above and was applied in the same way as described above.

The physical properties of the paper media samples were evaluated and compared to the controls. Tables 1 and 2 summarize the physical property data for the paper media samples described above (labeled 'New Media') and the control samples (labeled 'Control Media'). The reference '(Base Only)' means the respective uncoated Media (i.e., paper base) and '(Coated)' means the respective coated Media. In particular, basis weight, caliper, bulk, opacity, gloss, TAPPI brightness, and CIE Ganz whiteness in Table 1 were relatively comparable between the control samples and the new media samples. The Parker Print Surf (PPS) porosity of the 'Coated' samples was also relatively comparable possibly due to using the same image receiving coating and also the same calendering pressure for the New Media and the Control Media.

With respect to Table 2 and 'Base Only' samples, a higher moisture content and a lower ash content for the New Media relative to the Control Media were targeted during paper manufacturing and Table 2 indicates both were achieved. However, additional differences resulted between the 'Base Only' samples with respect to Hagerty smoothness and PPS Porosity (both in Table 1), and Cobb 10 and Hercules Size Test (HST) (both in Table 2) for the New Media and Control Media. In particular, the better Hagerty smoothness, the lower PPS porosity and slightly better sizing (i.e., high HST and low Cobb numbers) of the New Media (Base Only) sample compared to the Control Media (Base Only) are believed to be due to the increased fines and chemical retention which are due to a higher cationic starch to fiber ratio in the New Media samples relative to the Control Media samples. Moreover, it is believed that the increased cationic starch to fiber ratio contributed to increased measured tensile stiffness and strength, as described further below with respect to Table 3.

TABLE 1

| Media | Basis Weight (gsm) | Caliper (μm) | Bulk (μm/gsm) | Opacity % | Gloss 75 deg | TAPPI Brightness | CIE Ganz Whiteness | Hagerty Smoothness | PPS Porosity (mL/min) |
|---|---|---|---|---|---|---|---|---|---|
| Control Media (Base Only) | 50.5 | 68.3 | 1.35 | 86.4 | 6.3 | 85.5 | 98.6 | 140.0 | 622 |
| New Media (Base Only) | 50.2 | 67.6 | 1.34 | 83.4 | 7.6 | 85.4 | 103.4 | 127.9 | 446 |
| Control Media (Coated) | 63.5 | 68.6 | 1.06 | 91.5 | 23.5 | 86.4 | 96.5 | 69.8 | 33 |
| New Media (Coated) | 64.2 | 66.0 | 1.05 | 90.6 | 19.6 | 85.5 | 97.6 | 69.8 | 38 |

TABLE 2

| Base Properties | Units | Control Media (Base Only) | New Media (Base Only) |
|---|---|---|---|
| Moisture | % | 3.8 | 4.7 |
| Ash Content | % | 13.5 | 11.2 |
| Cobb 10 (gsm) | Felt | 36.5 | 27.7 |
| | Wire | 35.1 | 29.8 |
| HST (sec) | Felt | 6.7 | 11.5 |
| | Wire | 8.0 | 12.0 |

Table 3 summarizes strength properties for the New Media samples and the Control Media samples in Table 1 (both the respective uncoated 'Base Only' samples and the respective 'Coated' samples). Table 4 lists the test methods used to produce some of the data in Tables 1, 2 and 3. In particular, the PPS porosity in milliliters per minute (mL/min) reported in Table 1 was measured for each sample using an air leak method and a PPS roughness/porosity tester according to TAPPI method T-555. A Tensile Stiffness Index (TSI) (i.e., MD/CD ratio) was determined using a Lorentzen & Wettre TSO device (commonly described as L&W TSO tester). It used an ultrasonic method to more accurately measure this property non-destructively. The Tensile Energy Absorption (TEA) was determined for the machine direction (MD) and the cross-machine direction (CD) of each sample using an Instron Tester and a 2.54 centimeter (cm) wide strip, 100 mm gauge length, according to TAPPI method T-494. From the measured TEA, a TEA Index (TEA per basis weight) in J/Kg for the MD and the CD of the different samples were calculated. In addition, Residual Tensile Energy Absorption (TEA) Indices (in J/Kg) for the samples in the MD and the CD were also determined. Residual TEA of the samples was measured using Instron Tensile tester after high temperature conditioning and folding of the paper sample to estimate the loss in tensile energy absorption and to replicate the high temperature drying after printing and folding in the finishing. A 2.54 cm wide strip of paper was conditioned at 150° C. for 7 minutes in an oven and folded with a bow by applying 1.81 Kg weight back and forth.

TABLE 3

| Sample | Tensile Stiffness Index (MD/CD Ratio) | Tensile Energy Absorption Index (J/Kg) MD | Tensile Energy Absorption Index (J/Kg) CD | Residual Tensile Energy Absorption Index (J/Kg) MD | Residual Tensile Energy Absorption Index (J/Kg) CD |
|---|---|---|---|---|---|
| Control Media (Base Only) | 2.47 | 493 | 418 | 308 | 292 |
| New Media (Base Only) | 1.95 | 712 | 1291 | 660 | 1036 |
| Control Media (Coated) | 2.25 | 586 | 687 | 49 | 257 |
| New Media (Coated) | 1.89 | 682 | 1087 | 80 | 484 |

TABLE 4

| Properties | Test Methods |
|---|---|
| Basis Wt | T-410, TAPPI Method |
| Caliper | T-411, TAPPI Method |
| Bulk | Ratio of caliper (microns)/Basis wt (gsm) |
| Opacity | T-425, TAPPI Method |
| Brightness | T-452, TAPPI Method |
| Gloss | T-480, TAPPI Method |
| Whiteness | CIE Ganz 82 Test Method |
| Smoothness (Hagerty) | T-538, TAPPI Method |
| PPS Porosity | T-555, TAPPI Method |
| TEA (Tensile Energy Absorption) | T-494, TAPPI Method |
| HST (Hercules Sizing Test) | T-530, TAPPI Method |
| Cobb | T-441, TAPPI Method |

Table 3 illustrates that the Tensile Stiffness Index (MD/CD ratio) is less than 2.0 for both the New Media (Base Only) sample and the New Media (Coated) sample, while for both of the Control Media counterparts, the MD/CD TSI ratios are both greater than 2.2. In addition, the MD/CD TSI ratio is less than 1.9 for the New Media (Coated) sample. The lower values achieved for the Tensile Stiffness Index for the New Media samples according to the principles described herein mean more random fiber orientations were achieved in the paper base. The low MD/CD ratio facilitates less CD hygro-expansion of the fibers which in turn leads to less cockle and less mis-registration and/or alignment issues during high speed web press printing with inkjet inks.

Further from Table 3, the TEA indexes of both the New Media (Base Only) and the New Media (Coated) were greater than 650 J/Kg in both the MD and CD. Moreover, both the MD and CD TEA indexes of the New Media (Base Only) were equal to or greater than about 700 J/Kg, while for the Control Media (Base Only), both the MD and CD TEA indexes were less than 500 J/Kg. In addition, the CD TEA indexes of both the New Media (Base Only) and the New Media (Coated) were greater than 1,000 J/Kg, while for the Control Media counterparts, the CD TEA indexes were less than 700 J/Kg. In fact, the respective MD and CD TEA Indexes for the New Media samples were each greater than the corresponding Control Media samples. For example, the CD TEA index of the New Media (Base Only) was about triple the Control Media (Base Only) index value. TEA predicts the durability of the media sheet under dynamic stress/work required to break the sheet, for example. These high tensile values for the New Media samples according to the principles described herein facilitate improved runnability during printing and during finishing with reduced tendency of web breaks, wrinkling, and creasing of the media.

With respect to residual TEA indexes for both MD and CD, the index values of New Media (Base Only) were at least double the values obtained from the Control Media (Base Only). In fact, the CD residual TEA index of the New Media (Base Only) was at least triple the Control Media (Base Only) index value. For the coated media, the residual TEA index values for the New Media (Coated) were almost double the values obtained for the Control Media (Coated). Higher residual strength of the sample translates into better runnability and finishing of the paper media. The residual TEA index results in Table 3 correlate well with observed improved runnability and finishing results described below.

Runnability/Finishing

The sample Media were used to produce book signatures with a Sigma Folder manufactured by Mueller Martini with a 76.2 centimeter unwinder and B200 Sigma Collator. Finishing quality parameters such as throughput with respect to paper jams, creasing and cut quality were observed. The runnability of the Control Media (Coated) sample through the finisher exhibited one or more of paper jams, creasing and cross-cutting issues. Cut paper edges of the Control Media were frayed and unacceptable for commercial high throughput applications such as books, magazines, newsprint, and brochures. In contrast, the New Media (Coated) sample was runnable through the finisher with no problems exhibited. For example, runnability of the New Media (Coated) sample up to 450 millimeter cut length with excellent cut quality and finishing were observed. As mentioned above, the residual TEA index values in Table 3 correlated with these results. The Control Media (Coated) sample simply lacked the residual TEA strength, especially residual CD strength, to perform acceptably during runnability and finishing.

Thus, there have been described examples of a paper media used in digital high speed inkjet web press printing and a method of making the same that has a MD/CD tensile stiffness index ratio that is less than 2.0, tensile energy absorption index greater than 500 J/Kg and a CD residual TEA index greater than 400 J/Kg. It should be understood that the above-described examples are merely illustrative of some of the many specific examples that represent the principles of what is claimed. Clearly, those skilled in the art can readily devise numerous other arrangements without departing from the scope defined by the following claims.

What is claimed is:

1. A media used in digital high speed inkjet web press printing, the media comprising:

a paper base having a MD/CD tensile stiffness index ratio less than 2.0 and a tensile energy absorption index greater than 500 J/Kg, the paper base comprising:

a mixture of fibers having a ratio of softwood to hardwood fibers within a range of 3 to 7 to 7 to 1;

an internal starch having a ratio of cationic starch to fiber greater than 1.0%; and a filler within a range of about 1.0% to about 12.0% of paper base weight; and an image receiving layer on a side of the paper base, wherein the media has a CD residual tensile energy absorption index greater than 300 J/Kg.

2. The media of claim 1, wherein the media has a basis weight that is less than or equal to about 75 grams per square meter.

3. The media of claim 1, wherein the cationic starch to fiber ratio is within a range of 1.10% to about 5.0%.

4. The media of claim 1, wherein an amount of the internal starch is within a range of 1.10% to about 11% of fiber weight.

5. The media of claim 1, wherein the fiber mixture comprises a range of about 25% to about 35% softwood chemical pulp, a range of about 20% to about 30% hardwood chemical pulp, and a combined amount in a range of 0% to about 50% mechanical pulp, a hybrid pulp and recycled pulp, wherein a total amount of softwood in the fiber mixture is at least 30%.

6. The media of claim 1, wherein the fiber mixture comprises about 30% softwood chemical pulp, about 25% hardwood chemical pulp, about 18% hybrid pulp and about 25% recycled pulp, such that a total amount of softwood in the fiber mixture is greater than 30%.

7. The media of claim 1, wherein one or both of up to about 15% of the fiber mixture is recycled pulp and up to about 10% of the fiber mixture is one or both of mechanical pulp and a hybrid pulp.

8. The media of claim 1, wherein the ratio of softwood to hardwood fibers comprises a ratio of softwood kraft pulp to hardwood kraft pulp of about 6 to about 5.

9. The media of claim 1, wherein the paper base has a MD residual tensile energy absorption index and a CD residual tensile energy absorption index that are each greater than 500 J/Kg.

10. The media of claim 1, wherein the paper base and the media each has a CD tensile energy absorption index that is greater than 800 J/Kg.

11. A media used in high speed inkjet web press printing, the media comprising:

a paper base having a tensile energy absorption index greater than 600 J/Kg comprising:

a mixture of fibers having a ratio of softwood to hardwood fibers within a range of 3 to 7 to 1 to 1;

an internal starch having a ratio of cationic starch to fiber within a range of greater than 1.0% to about 5.0%;

a filler in an amount sufficient to achieve less than about 12.0% ash content; and one or more agents and additives in a combined amount within a range of about 0.0075% to about 9.0% of fiber weight; and an ink receiving layer on both sides of the paper base, wherein each of the media and the paper base has a MD/CD tensile stiffness index ratio of less than 2.0 and CD tensile energy absorption index greater than 800 J/Kg.

12. The media of claim 11, wherein the fiber mixture further comprises one or more of recycled pulp, hybrid pulp and mechanical pulp in an amount independently within a range of about 10% to about 30%.

13. The media of claim 11, wherein the paper base has a residual tensile energy absorption index equal to or greater than 600 J/Kg.

14. The media of claim 11, wherein the media has a MD residual tensile energy absorption (TEA) index greater than 60 J/Kg and a CD residual TEA index greater than 300 J/Kg.

15. A method of making media for high speed inkjet web press printing, the method comprising:

forming a pulp stock comprising a ratio of softwood fiber to hardwood fiber ranging from 3 to 7 to 7 to 1, an internal starch having cationic starch to fiber ratio greater than 1.0%, and a filler ranging from about 1.0% to about 12% by weight of the pulp stock;

jetting the pulp stock onto a moving wire screen at a jet-to-wire speed ratio of about 1.0 to form an initial paper web;

removing water from the initial paper web in a manner that prepares the paper web for surface sizing and coating, the paper web having a tensile energy absorption index greater than 500 J/Kg and an MD/CD tensile stiffness index ratio of less than 2.0;

coating the paper web on one or both sides with an image receiving layer; and calendering the coated paper web to form the media, wherein the media has a CD residual tensile energy absorption index greater than 300 J/Kg.

* * * * *